United States Patent [19]

Berry

[11] Patent Number: 4,510,859

[45] Date of Patent: Apr. 16, 1985

[54] SUPERCALENDER NIP RELIEVING ARRANGEMENT

[75] Inventor: Kenneth W. Berry, Beloit, Wis.

[73] Assignee: Beloit Corporation, Beloit, Wis.

[21] Appl. No.: 573,109

[22] Filed: Jan. 23, 1984

[51] Int. Cl.[3] ..... B30B 3/04

[52] U.S. Cl. ..... 100/35; 100/47; 100/162 R; 100/170

[58] Field of Search ..... 100/35, 47, 161, 162 R, 100/163 R, 163 A, 168, 169, 170

[56] References Cited

U.S. PATENT DOCUMENTS

| | | | |
|---|---|---|---|
| 2,985,100 | 1/1958 | Hornbostel . | |
| 3,016,819 | 1/1962 | Kupka . | |
| 3,364,848 | 1/1968 | Müller . | |
| 3,369,483 | 2/1968 | Müller . | |
| 3,554,118 | 1/1971 | Laine | 100/170 X |
| 3,584,570 | 6/1971 | Sass et al. | 100/170 X |
| 4,290,351 | 9/1981 | Pav et al. . | |
| 4,311,091 | 1/1982 | Pav et al. . | |
| 4,347,784 | 9/1982 | Pav et al. | 100/170 X |

FOREIGN PATENT DOCUMENTS

| | | |
|---|---|---|
| 1054953 | 4/1959 | Fed. Rep. of Germany . |
| 1931385 | 2/1970 | Fed. Rep. of Germany . |

*Primary Examiner*—Peter Feldman

*Attorney, Agent, or Firm*—Hill, Van Santen, Steadman & Simpson

[57] ABSTRACT

Load transfer rod columns extending upwardly along slide blocks of the bearing structures of calender rolls have associated therewith hydraulically operated assemblies for acting on the bearing structures whereby to selectively transfer to the rod columns the overhanging deadweight of the bearing structures when the rolls are in their nipping mode for maintaining the rolls in straight and parallel nip relation. The rod columns thrust downwardly against a load supporting base, which conveniently comprises the slide blocks of a king roll at the bottom of the calender stack.

20 Claims, 8 Drawing Figures

SUPERCALENDER NIP RELIEVING ARRANGEMENT

BACKGROUND OF THE INVENTION

1. Field of the Invention

The present invention relates to supercalenders of the type wherein the rolls are adapted for limited separation from one another in one mode and are in calendering nipping engagement with one another in another mode.

2. Description of the Prior Art

Supercalenders with which the present invention is concerned are well known in the art and comprise a substantial stack of calender rolls wherein separation of the rolls may be controlled either from the top or the bottom of the stack. Where control is from the bottom of the stack, a king roll at the bottom of the stack is moveable between a lowered position and a raised position. In the lowered position of the king roll, a substantial number of calender rolls thereabove separate from one another to provide gaps therebetween to facilitate threading a new web of material through the stack or to relieve any damaging effect of broke or creased web passing through the roll nips. As thus gapped, the opposite ends of the rolls are supported by their bearing structures on shoulders along upright suspension spindles at the opposite sides of the stack. In the calendering mode of the stack, the king roll, acting through the next adjacent calendering roll, pushes all of the rolls thereabove into nipping relation, wherein the bearing structures for the rolls are lifted from the spindle shoulders. For uniform nip loading, the topmost roll in the stack may be hydraulically biased downwardly. Calenders of the type just described are represented in U.S. Pat. Nos. 3,364,848, 3,369,483, 4,290,351 and 4,311,091.

Inasmuch as the calender rolls are quite heavy, such for instance as about 42,000 pounds each in a supercalender, their bearing structures must be fairly massive to afford adequate support when the rolls are individually supported on the spindles. Typically each bearing structure at each end of each of the rolls may weigh from 4,000 to 5,000 pounds. Therefore, when the rolls are lifted to the nipping, calendering mode, and the bearing structures are in deadweight or overhung weight relation at each end of each roll, the deadweight end loads on the rolls tend to distort the rolls and thus distort the nips between the rolls from the ideal straight line. In other words, ideally the rolls should be ground straight and parallel, without any crown so as to present uniform and straight nips to the paper sheet passing between them, and that relationship should be maintained during the calendering operation.

Heretofore there have been some proposals for relieving bearing deadweight end loads from the rolls. In U.S. Pat. No. 2,985,100, individual load relieving is disclosed as accomplished by means of cables suspended from a frame and carrying stops connected to linking arms, and with pneumatic cylinders connecting the bearing housings with the linking arms which are articulated for the purpose. This patented arrangement is intended only for ordinary paper machine calenders wherein the calender rolls may weigh approximately 10,000 pounds and the bearings about 1,000 pounds each. These weights are only ¼ to 1/5 of the weights involved in supercalenders. This patented arrangement is unsuited to relieving the dead load of the massive bearing structures of supercalenders.

In British Pat. No. 1,482,379 of 1977, an arrangement is disclosed wherein hydraulic pistons are carried by the nuts mounted on the threaded spindles which are suspended from the cheek plates of the uppermost roll in the stack and which nuts are adapted to effect separation of the rolls upon raising of the top roll. In the nipping mode of the rolls, the hydraulic pistons are adapted to be activated upwardly for relieving the deadweight load of the roll bearings. The hydraulic pistons are also activatable to reduce the entire roll pressure to the extent that the resilient rolls are not damaged during the passage of a joint in the web. When it is desired to separate the nips of the rolls into a gapping relation, it is necessary to deenergize the hydraulic devices, and then when the rolls are returned to the nipping relation if it is desired to effect bearing weight relief, the hydraulic devices must be reenergized.

SUMMARY OF THE INVENTION

An important object of the present invention is to provide a new and improved means and method for relieving the deadweight load of the bearing structures of calenders, and in particular supercalenders, in the nipping mode of the calender rolls.

To this end, the present invention provides a method of operating a calender having a vertical stack of a plurality of rotary rolls, each of the rolls having a bearing structure at each opposite end provided with slide block means, means for guiding the slide block means for vertical movement, and means for vertically shifting the rolls between a spaced apart independent suspension mode and a nipping mode relation with one another, and comprising in the nipping mode of the rolls selectively imposing the overhung weight of the bearing structures onto load transfer means extending upwardly from a load-supporting base and along the slide block means of the bearing structures, and thereby thrusting the weight through the load transfer means downwardly against the load-supporting base, and thus maintaining the rolls in straight and parallel nip relation in the nipping mode.

For practicing the method, the present invention provides a calender having a vertical stack of a plurality of rotary rolls, each of the rolls having a bearing structure at each opposite end provided with slide block means, means for guiding the slide block means and thereby said bearing structures for vertical movement, and means for vertically shifting the rolls between a spaced apart independent suspension mode and a nipping mode relation with one another, and comprising load transfer means extending upwardly along the slide block means and thrusting downwardly against a load supporting base, and means carried by the slide block means for selectively imposing the overhung weight of the bearing structures to the load transfer means in the nipping mode for thereby maintaining the rolls in straight and parallel nip relation.

BRIEF DESCRIPTION OF THE DRAWINGS

Other objects, features and advantages of the present invention will be readily apparent from the following description of a representative embodiment thereof, taken in conjunction with the accompanying drawings, although variations and modifications may be effected without departing from the spirit and scope of the novel concepts embodied in the disclosure, and in which.

DETAILED DESCRIPTION

Figure 1:
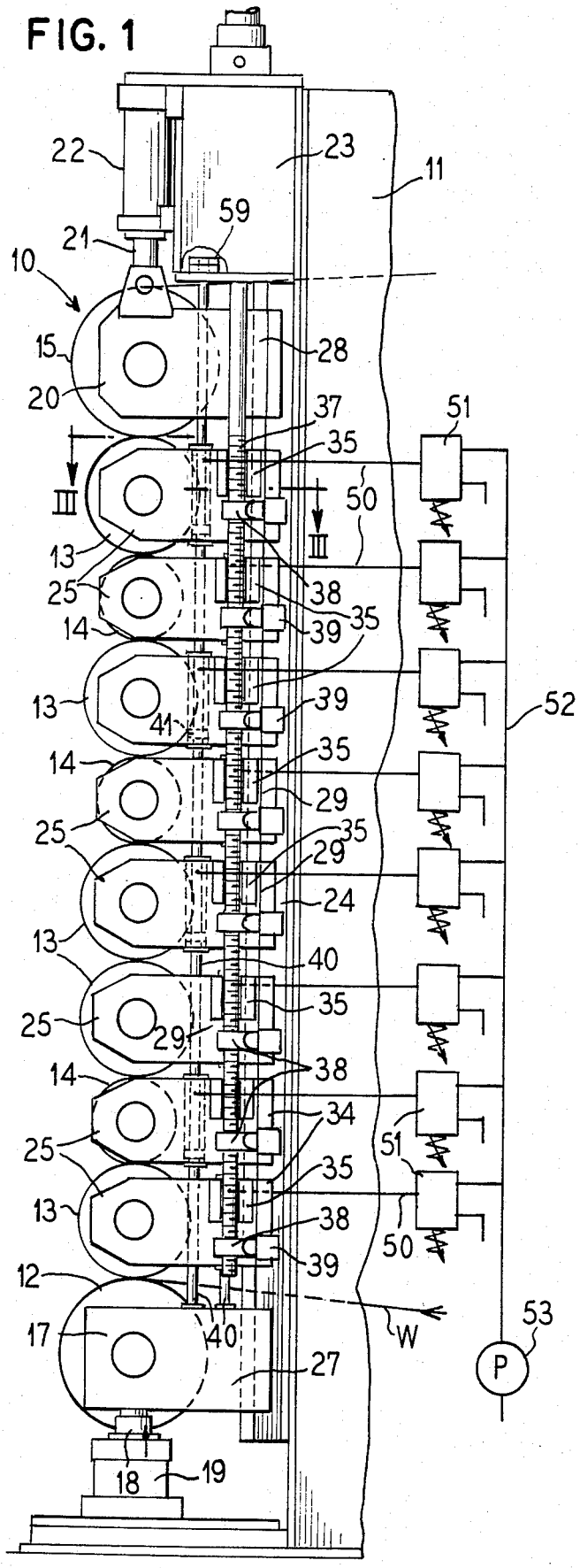
FIG. 1 is a more or less schematic side elevational view of a supercalender embodying the invention and showing the rolls in the calendering mode.
Figure 2:
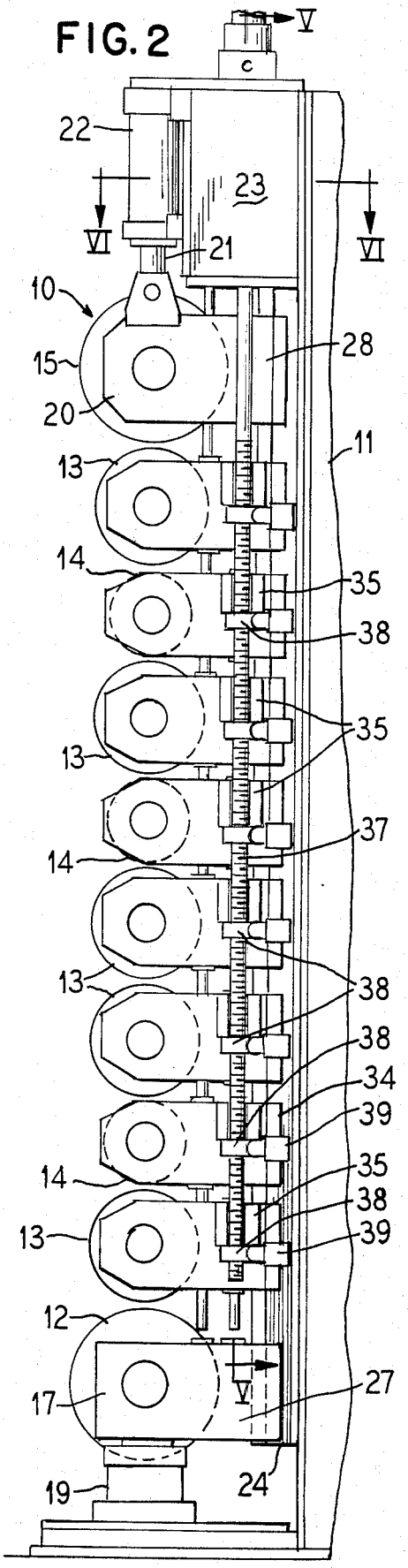
FIG. 2 is a similar view showing the rolls in the open or spaced apart independent suspension mode of the rolls.

Referring to FIGS. 1 and 2, one side of a supercalender is depicted wherein a vertical stack of calender rolls 10 is supported by a frame 11. Only one side of the calender is depicted, and it will be understood that the opposite side will be substantially mirror image of the illustrated side, and the description will assume such substantial similarity of both sides, and in particular the structures involving the bearings at each opposite end of each of the calender rolls in the stack 10.

In a preferred arrangement, the calender stack 10 comprises a lowermost king roll 12 and thereabove a series of resilient or filled (i.e., composed of a core supporting a concentric pack of cotton, paper or fibrous disks) rolls 13, and solid surface, cast iron rolls 14 which, in general, are alternated in the stack, except near the center of the stack where a pair of the filled rolls 13 have nipping relation with one another so that a web W being calendered will be exposed to the smoothing action of these filled rolls on both sides. At the top of the stack 10, a head roll 15 bears downwardly on the stack of rolls in the calendering mode for attaining substantially uniform nipping pressure between all of the rolls in the stack.

Although in some calenders the topmost roll serves not only as a pressure roll but also as a lifting roll by which all of the rolls except the lowermost roll are lifted into the separating relation, the preferred arrangement shown in FIGS. 1 and 2 has the lower or king roll 12 in control of both the calendering mode as shown in FIG. 1 and the open roll mode shown in FIG. 2. For this purpose supporting bearing structures 17 at each end of the king roll 12 have associated thereunder upwardly thrusting hydraulic plungers 18 of hydraulic cylinder actuators 19 adapted to thrust the king roll 12 upwardly as shown by directional arrow in FIG. 1 for the calendering mode, and to drop the king roll 12 rapidly for the open roll mode as shown in FIG. 2. On the other hand, the top roll 15 has its bearing structures 20 at each opposite end adapted to be thrust downwardly by means of a respective hydraulic actuator piston plunger 21 having its hydraulic cylinder 22 mounted on the frame 11 at the side of a chambered housing 23 fixed upon the upper end portion of the frame. The actuators 22 are adapted to be activated, after the hydraulic actuators 19 have raised the king roll 12 into the calendering mode, for attaining the desired substantial uniformity of calendering load on the stack 10. As shown in FIG. 2, in the open roll mode, the actuators 22 maintain the upper roll 15 suspended above the rolls therebelow.

Figure 3:
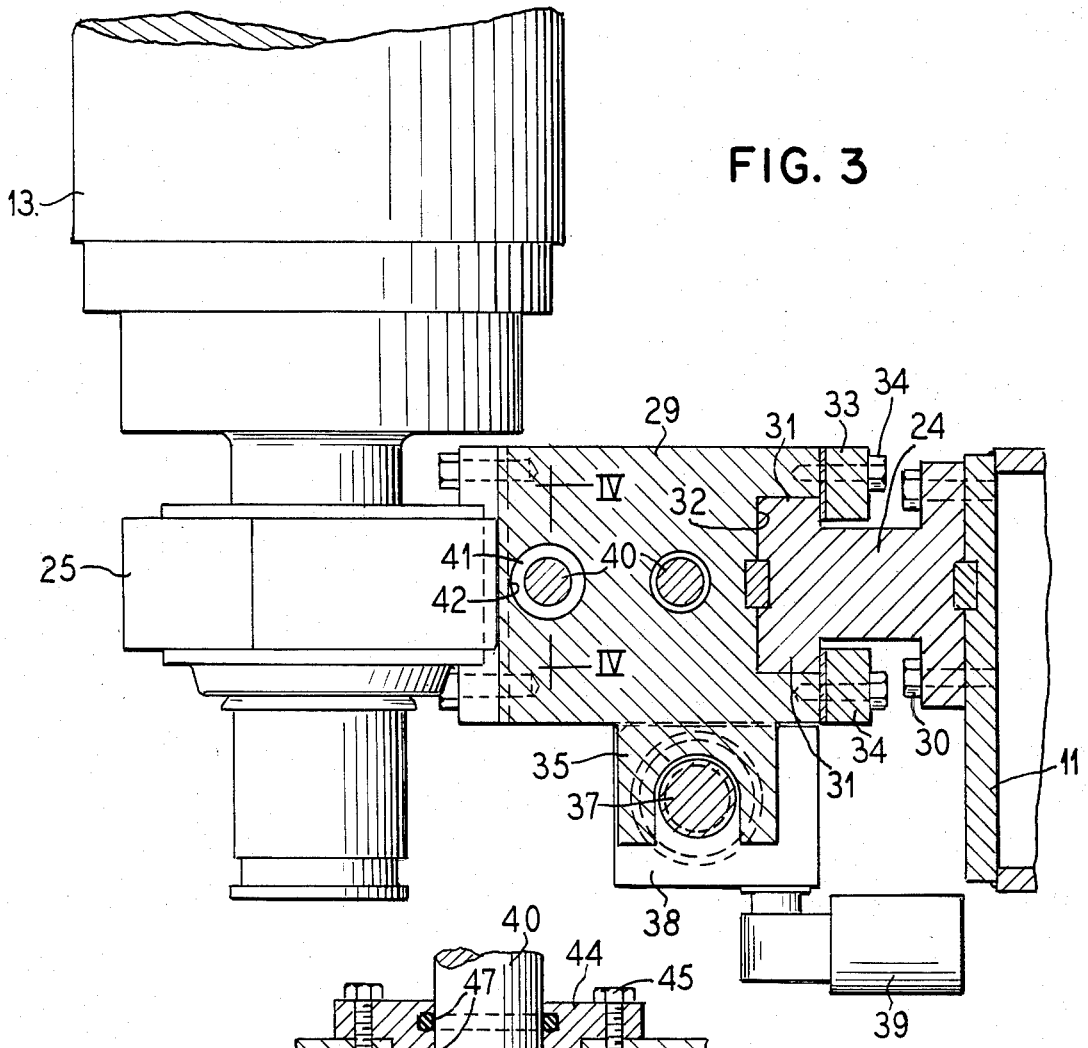
FIG. 3 is an enlarged fragmentary sectional plan view taken substantially along the line III—III in FIG. 1.

For guiding all of the rolls in the stack 10 for vertical movement along the upright supporting structure frame 11 vertical rails 24 are provided at each side of the stack and extend the full length from top to bottom of the stack for slidable tracking engagement with the bearing structures of the several rolls. Each of the intermediate rolls 13 and 14 has a similar bearing structure 25 at each opposite end. While the king roll has slide blocks 27 slidably engaged with the rails 24, and the bearing structures of the upper roll 15 have slide blocks 28 similarly engaged with the rails 24, each of the bearing structures 25 of the rolls 13 and 14 preferably has a slide block 29 (FIG. 3) engageable with the associated rail 24.

In a preferred construction, the rail 24 is secured as by means of bolts 30 to the frame 11 and has a rail head provided with respective parallel lateral rail flanges 31. Thereby, the rail head is adapted to be engaged slidably within a complementary track groove 32 of the slide block 29, and respective retainer plates 33 secured as by means of bolts 34 to the slide block and disposed in lapping relation at the outer sides of the flanges 31 will retain the slide block 29 in operative sliding engagement with the rail.

Each of the slide blocks 29 has a functionally integral yoke 35 at its outer side and within which the shank of a threaded screw spindle 37 is received. Thereby the yoke 35 is engageable with an underlying supporting stop shoulder 38 in the form of a stop nut threadedly engaged on the spindle 37 and readily adjustable threadedly therealong as by means of a selectively operable device including a motor 39, as is known practice. Each of the stop shoulders 38 is adapted to be selectively adjusted to attain the desired spacing between its associated roll and the contiguous rolls. In a preferred relationship, such spacing may be progressively greater from the uppermost roll nip to the lowermost roll nip. For example, at the uppermost nip the spacing may be about 1½ inch, and the spacing of each successive nip downwardly in the stack may increase by about 0.2 inch increment so that in a stack having the number of rolls shown, the lowermost nip spacing in the open condition of the rolls may be about 2.1 inch. This facilitates threading or any other web condition or event requiring a spaced apart mode of the rolls, where the web W travels upwardly through the calender. Each of the spindles 37 is thoroughly anchored at the top of the frame 11 by means including the chambered structure 23.

It may be noted that by the term "bearing structure" is meant all of the structural elements at each end of each of the rolls 13 and 14 contributing to the overhung load or deadweight when the rolls are in the nipping mode relation to one another, as indicated in FIG. 1. The overhung or deadweight that is then present is contributed to by not only the roll journals, bearings and bearing housings which are generally identified as 25 but also the slide blocks 29 and appurtenance (e.g. the track retainer plates 33, the shoulder yokes 35 and various bolts).

According to the present invention, a new and improved method of and means are provided for relieving the overhung or deadweight load of the bearing structures of the rolls 13 and 14 in the nipping mode relation of the rolls to one another. This comprises selectively imposing the load onto load transfer means extending upwardly along the slide blocks 29 of the bearing structures and thereby thrusting the load through the load transfer means downwardly against a load-supporting base, and thus in the nipping mode maintaining the rolls 13 and 14 in straight parallel nip relation. Although this may be accomplished in various ways, within the concepts of the present invention, in a preferred arrangement the load transfer means comprises a combination mechanical and hydraulic device including elongate piston rods 40 in sections extending end-to-end vertically through the slide blocks 29 in two parallel columns, one column being for the filled rolls 13 and the other column being for the cast iron rolls 14. Both columns of piston rods 40 are in discrete sections arranged for end-to-end load sharing abuttment in the nipping mode relation of the rolls and adapted to separate from one another in the open, spaced apart independent suspension mode of the rolls.

Figure 4:
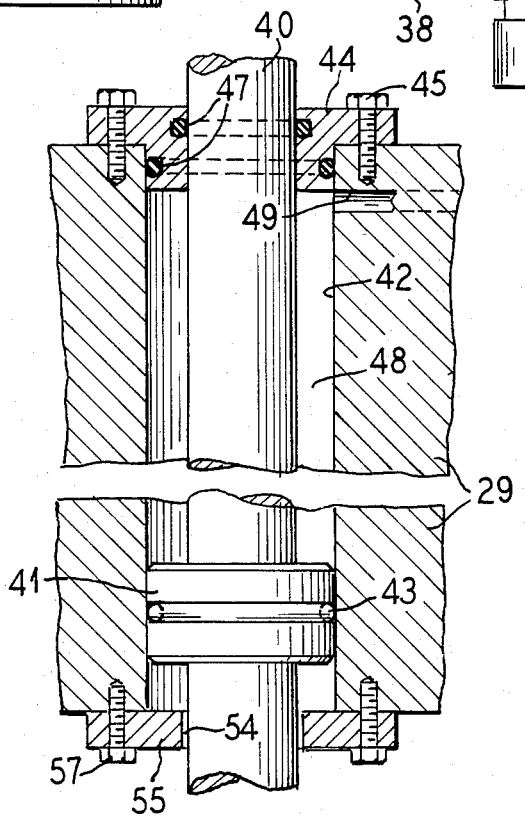
FIG. 4 is a further enlarged fragmental vertical sectional detail view taken substantially along the line IV—IV in FIG. 3.

Each of the piston rods 40 has functionally integral therewith a piston 41 which is attached at an intermediate point on the associated rod 40, in a double rod arrangement, and is vertically reciprocably received in a cylinder 42 extending through the associated slide block 29 as best seen in FIG. 4. Seal means in the form of an O-ring in the perimeter of the piston 41 maintains a fluid type seal between the piston 41 and the wall of the cylinder 42. In each instance, the upper end of the cylinder 42 is sealed by a plug or cap 44 removably secured as by means of screws 45 to the top of the associated slide block 29. O-ring or other packing 47 provides a hydraulic seal between the associated rod 40 and the cylinder wall and the cap 44. Thereby, a hydraulic working chamber 48 is provided within the cylinder 42 between the piston 41 and the closure 44, and hydraulic pressure is adapted to be delivered into or bled from the chamber 48 through a port 49 with which communicates hydraulic duct 50 (FIG. 1) leading from a variable pressure valve 51 and adapted to receive hydraulic pressure through a supply line 52 connected to a hydraulic fluid source through pressurizing means such as a pump 53. It will be appreciated that by means of the variable pressure valves 51 the most efficient hydraulic pressure may be selectively chosen for each of the bearing structures to attain the optimum weight relieving results.

Each of the piston rods 40 extends to an appropriate extent above and below the slide block 29 with which the piston 41 of the piston rod is associated. As best visualized in FIG. 1, 7 and 8, each series or column of the rods 40 abutting end-to-end thrusts downwardly at its lower end against a load supporting base desirably provided by the slide block 27 of the lowermost or king roll 12 in the nipping mode of the rolls. With the aligned, abutting rods thus based, hydraulic pressure within the respective working cylinder chambers 48 causes upward lifting reaction between the thus stationarily held piston 41 in each instance and the pressure head provided by the associated closure 44. By means of pressure sensors functioning in known manner in connection with the hydraulic system, the desired lifting pressure is adapted to be attained in each of the cylinder working chambers 48 to effect the desired overhung weight relief for each of the bearing structures 25, and the total downward thrusting reaction or load transfer being through the align, contacting rods 40 to the base provided by the slide block 27.

Figure 5:
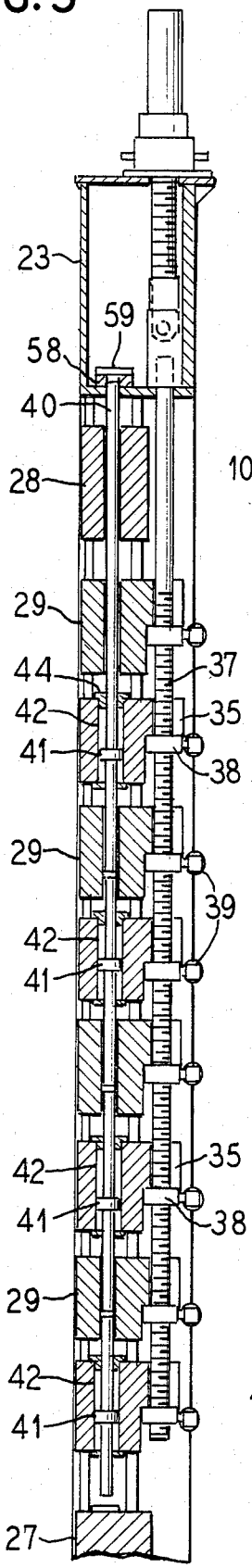
FIG. 5 is a vertical sectional detail view taken substantially along the line V—V in FIG. 2.
Figure 6:
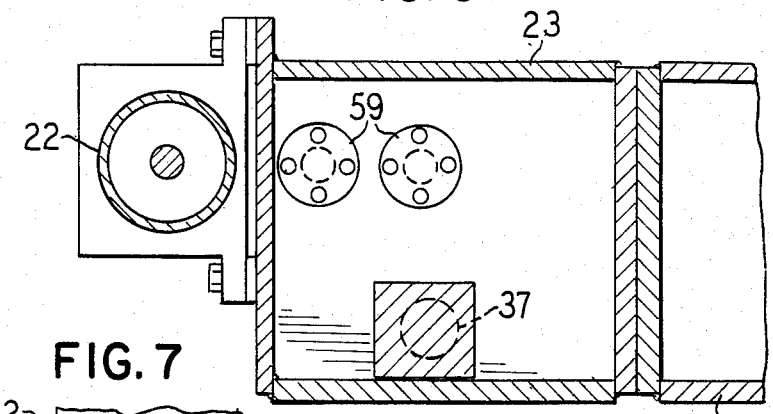
FIG. 6 is an enlarged fragmentary sectional plan view taken substantially along the line VI—VI in FIG. 2.

The arrangement is such that once the desired hydraulic pressure has been ascertained for each of the pistons, the pressure valves 51 may be set to maintain that pressure relatively fixed, although readily adjustable when necessary. Therefore, when the roll stack 10 is opened by dropping of the king roll 12 as shown in FIGS. 2 and 5, the hydraulic pressure in each cylinder may be retained, even though the ends of the rods 40 projecting above and below the respective slide blocks 29 separate endwise generally conformable to the controlled spaced apart independence suspension mode of the several rolls. When the rolls stack 10 is returned to the nipping mode, the bearing structure overhang relief function is resumed.

Figure 7:
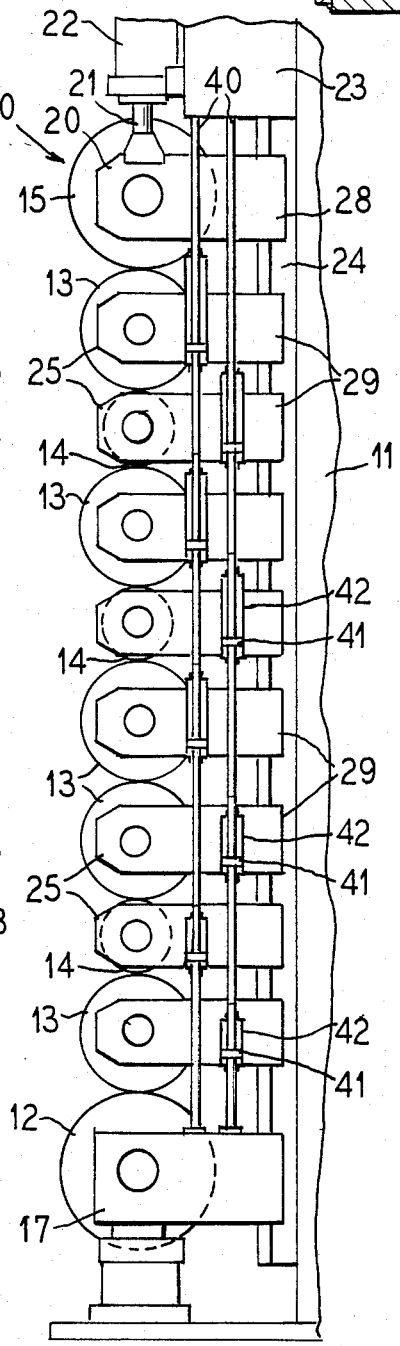
FIG. 7 is a fragmentary schematic side elevational view with the threaded roll supporting nut carrying spindle omitted and showing the relationship of the bearing weight relieving load transfer means and the rolls in the nipping mode when the resilient or filled rolls are at substantially full diameter.
Figure 8:
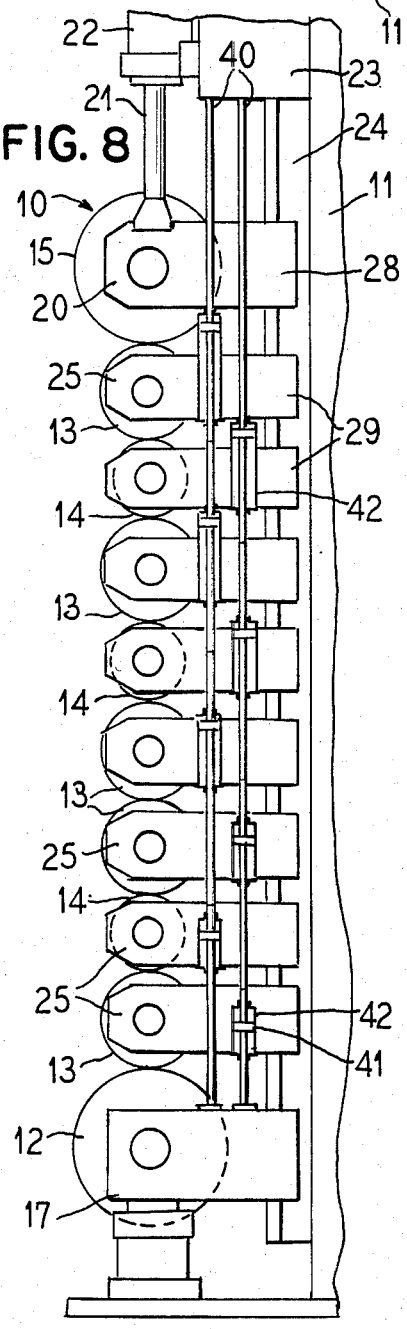
FIG. 8 is a view similar to FIG. 7, but showing the calender in the nipping mode when the filled rolls are quite worn down.

For improved load distribution, each of the columns of piston rods 40 has the pistons 41 and associated cylinders 42 located in alternate ones of the slide blocks 29, as best visualized in FIGS. 7 and 8. The uppermost rod sections in each of the rod columns, extend freely upwardly through the slide block 28 of the top roll 15 and into respective stabilizing means comprising terminal guides 58 on the lower wall of the housing 23 permitting the upper rod sections to have a desired range of vertical reciprocal movement to accommodate the nipping and spaced suspension modes of the roll stack. Upward thrust shoulder means provided by disks 59 secured across the tops of the guides 58 are adapted to resist upward displacement of the rods 40 during pressurizing of the cylinder chambers 48 and consequent lifting of the slide blocks 29 when adjusting for the bearing structure overhanging weight relief.

Another advantage of having the pistons 41 and associated cylinders 42 relatively staggered in the two columns of piston rods 40 resides in that ample latitude is provided for taking up slack in the nipping mode of the roll bank 10 due to wear of the filler rolls 13. For example, the filled rolls 13 may require resurfacing at frequent intervals causing a gradual reduction in diameter which may amount to as much as six inches in large diameter rolls. Where, for example, five filled rolls are embodied in the roll stack, there must be a height range capability of at least 30 inches. The double rod and cylinder column arrangement provides for sufficient stroke capability to maintain effective bearing struture overhanging load relief throughout the range exemplified as at maximum height or upper position in FIG. 7 and a minimum height position exemplified in FIG. 8.

It will be understood that variations and modifications may be effected without departing from the spirit and scope of the novel concepts of this invention.

I claim as my invention:

1. A method of operating a calender having a vertical stack of a plurality of rotary rolls, each of said rolls having at each end a bearing structure with slide block means, means for guiding said slide block means and thereby said bearing structures for vertical movement, and means for vertically shifting said rolls between a spaced apart independent suspension mode and a nipping mode relation to one another, and comprising:

in said nipping mode of said rolls relieving the overhung weight of said bearing structures by imposing such weight onto load transfer means extending upwardly from a load-supporting base and along said slide block means and, thereby thrusting said weight through said load transfer means downwardly against said load-supporting base;

and thus maintaining said rolls in straight and parallel nip relation in said nipping mode.

2. A method according to claim 1, which comprises providing said load transfer means as a columnar arrangement of piston rod sections, and operating piston and cylinder means associated with said slide blocks for effecting said relieving of the overhung weight.

3. A method according to claim 1, which comprises providing said load transfer means in the form of sectional piston rod columns, abutting the sections in the columns in the nipping mode relation of the rolls, and separating said sections in the spaced apart independent suspension mode of the rolls.

4. A method according to claim 3, which comprises thrusting the lower ends of said columns against slide blocks of king roll bearing structures at the bottom of said stack serving as said load supporting base.

5. A method according to claim 1, which comprises operating hydraulic piston and cylinder devices in effecting imposing of said overhung weight onto said load transfer means.

6. A calender having a vertical stack of a plurality of rotary rolls, each of said rolls having a bearing structure at each opposite end provided with slide block means, means for guiding said slide block means and thereby said bearing structures for vertical movement, and means for vertically shifting said rolls between a spaced apart independent suspension mode and a nipping mode relation to one another, and comprising:

load transfer means extending upwardly along said slide block means and thrusting downwardly against a load supporting base;

and means carried by said slide block means for selectively imposing the overhung weight of said bearing structures to said load transfer means in said nipping mode for thereby maintaining said rolls in straight and parallel nip relation.

7. A calender according to claim 6, wherein said load transfer means comprises rod columns.

8. A calender according to claim 7, wherein said rod columns comprise end-to-end rod sections which are in endwise abuttment in the nipping mode of said rolls and which are adapted to be separated in the spaced apart independent suspension mode of said rolls.

9. A calender according to claim 8, including hydraulic piston and cylinder means associated with said rod sections.

10. A calender according to claim 6, wherein said load transfer means comprises an arrangement of pistons and cylinders and columnar piston rod sections in alignment.

11. A calender according to claim 6, wherein said means carried by the slide block means includes hydraulic cylinder and piston assemblies.

12. A calender according to claim 6, wherein said load transfer means comprises a plurality of rod columns associated with the slide block means at each end of said rolls.

13. A calender according to claim 12, wherein said stack includes a king roll at the lower end of the stack including bearing structures having slide blocks, and said king roll bearing structure slide blocks provide said load-supporting base.

14. A calender according to claim 6, wherein said stack comprises filled rolls which wear down so that the stack reduces in height, and said load transfer means being adaptable to accommodate said reduced height.

15. A calender according to claim 6, wherein said load transfer means comprises rod columns extending through said slide block means, and hydraulic cylinder and piston structure within said slide block means and associated with said rod columns.

16. A calender according to claim 15, including means at the upper ends of said columns for stabilizing the columns in the operation of said hydraulic cylinders and pistons.

17. A calender according to claim 15, including means for controlling operation of said hydraulic cylinder and piston assemblies.

18. A supercalender having a vertical stack of a plurality of rolls comprising a top roll, a king roll at the bottom of the stack, and intermediate rolls comprising generally alternate filled rolls and solid surface rolls, said king roll having bearing structure at opposite ends including slide blocks, said intermediate rolls having respective bearing structures at opposite ends including slide blocks, vertical rails, said slide blocks having tracking means slidably engaging the rails, said king roll controlling vertical movement of said intermediate rolls between a spaced apart independent suspension mode and a nipping mode relation to one another, and comprising:

rod columns extending through said intermediate roll slide blocks;

hydraulic cylinder and piston assemblies in said slide blocks associated with said piston rods;

lower ends of said columns thrusting against said king roll slide blocks;

and means for hydraulically activating said cylinder and piston assemblies for relieving overhung bearing structure load by raising said intermediate roll slide block in the nipping mode of said rolls.

19. A calender according to claim 18, wherein said rod columns comprise a pair of such columns extending through each of said intermediate roll slide blocks, and piston and cylinder assemblies in association with said columns in said intermediate roll slide blocks.

20. A calender according to claim 18, wherein said columns comprise rod section which are in end-to-end abuttment in the nipping mode of said rolls and which are separable in the spaced apart independent suspension mode of the rolls, vertical spindles extending along said intermediate roll slide blocks and carrying at spaced selected intervals therealong shoulder means engageable by shoulder means on said intermediate roll slide blocks for supporting said rolls in said spaced apart independent suspension mode, said rod sections assuming endwise spacing in said spaced apart independent suspension mode equal to the spacing between rolls in such mode.

* * * * *